US005896923A

United States Patent [19]

Baba

[11] Patent Number: 5,896,923

[45] Date of Patent: Apr. 27, 1999

[54] HEAT EXCHANGER HAVING DOWNSIZED HEADER TANK

[75] Inventor: Norimasa Baba, Toyoake, Japan

[73] Assignee: Denso Corporation, Kariya, Japan

[21] Appl. No.: 09/095,193

[22] Filed: Jun. 10, 1998

[30] Foreign Application Priority Data

Jun. 24, 1997 [JP] Japan ..... 9-167472

[51] Int. Cl.[6] ..... F28F 9/04

[52] U.S. Cl. ..... 165/173; 165/153; 165/178

[58] Field of Search ..... 165/153, 173, 165/175, 178; 29/890.043

[56] References Cited

U.S. PATENT DOCUMENTS

| | | | |
|---|---|---|---|
| 3,411,196 | 11/1968 | Zehnder | 165/175 X |
| 4,722,387 | 2/1988 | Avrand | 165/153 |
| 5,069,277 | 12/1991 | Nakamura et al. | 165/173 |
| 5,127,466 | 7/1992 | Ando | 165/173 X |
| 5,842,515 | 12/1998 | Kim | 165/175 |

FOREIGN PATENT DOCUMENTS

| | | |
|---|---|---|
| 0 532 794 | 3/1993 | European Pat. Off. . |
| 240398 | 8/1992 | Japan . |
| 2285858 | 7/1995 | United Kingdom . |

*Primary Examiner*—Leonard R. Leo
*Attorney, Agent, or Firm*—Harness, Dickey & Pierce, PLC

[57] ABSTRACT

A heat exchanger includes first and second header tanks and a plurality of flat tubes disposed therebetween. Each of the first and second header tanks is formed by connecting first and second groove members. The first groove member includes a main wall portion and a side wall portion to have a U-shaped cross-section. A plurality of tube-insertion holes are provided in the first groove member, and the tube-insertion holes extend from the main wall portion until an intermediate position of the side wall portion. The flat tubes are attached to the first and second header tanks by inserting both ends of each flat tube into the tube-insertion holes until the intermediate position. Further, a width of the first groove member in a width direction is set to be equal to each width of the flat tubes. As a result, the sizes of the first and second header tanks are reduced relative to the flat tubes, and the heat exchanger has downsized header tanks.

7 Claims, 4 Drawing Sheets

HEAT EXCHANGER HAVING DOWNSIZED HEADER TANK

CROSS-REFERENCE TO RELATED APPLICATION

This application relates to and claims priority from Japanese Patent Application No. Hei. 9-167472 filed on Jun. 24, 1997, the contents of which are hereby incorporated by reference.

BACKGROUND OF THE INVENTION

1. Field of the Invention

The present invention relates to a heat exchanger having first and second header tanks and a plurality of flat tubes disposed in parallel with each other between the first and second header tanks. The heat exchanger is suitable for a condenser for condensing refrigerant.

2. Description of Related Art

JP-A-4-240398 proposes a heat exchanger which includes two tubular header tanks and a plurality of flat tubes. Each of the header tanks has a plurality of oval-shaped tube-insertion holes on a circumference surface thereof. Both ends of each flat tube are inserted into the tube-insertion holes so that the two header tanks and the flat tubes are integrally connected to be communicated with each other.

In the heat exchanger, to prevent fluid (e.g., refrigerant) from leaking from a joint portion between the header tanks and the flat tubes, each end of the flat tubes is inserted into the insides of the header tanks so that the flat tubes are firmly attached to the header tanks. Therefore, each outer dimension of the header tanks is made larger than each width of the flat tubes. Thus, the size of the header tanks becomes larger; and accordingly, the size of the heat exchanger also becomes larger. Further, because the heat exchanger can not be reduced in size, a volume of fluid flowing through the heat exchanger cannot be reduced.

As shown in FIG. 6, an another type heat exchanger is also known. In the heat exchanger, a first header tank 11 includes a first groove member 110 and a second groove member 111, and a second header tank 12 includes a first groove member 120 and a second groove member 121. The first groove members 110, 120 have a plurality of tube-insertion holes (not shown) into which flat tubes 14 are inserted. That is, in the heat exchanger, because the flat tubes 14 are inserted inside the first groove members 110, 120 through the tube-insertion holes, each width of the first groove members 110, 120 in a left-right direction in FIG. 6 is larger than each width of the flat tubes 14 as shown in FIG. 6. Thus, the width of the header tanks 11, 12 becomes larger relative to that of the flat tubes, and thereby increasing the size of the heat exchanger.

SUMMARY OF THE INVENTION

In view of the foregoing problems, it is an object of the present invention to provide a heat exchanger having downsized header tanks.

According to the present invention, a heat exchanger includes first and second header tanks and a plurality of flat tubes disposed therebetween. The first header tank includes a first groove member having a plurality of insertion hole into which the flat tubes are inserted, and a second groove member connected to an outer peripheral portion of the first groove member. The first groove member is formed in a U-shaped cross section having a bottom wall portion and a side wall portion extending from the bottom wall portion, each of the insertion holes is formed to penetrate through the bottom wall portion and to extend from the bottom wall portion until an intermediate position of the side wall portion, and each first end of the flat tubes is inserted into the insertion holes until the intermediate position of the side wall while contacting both the first groove member and second groove member. Thus, the flat tubes can be readily accurately connected to the first and second header tanks. Further, because each first end of the flat tubes is inserted into the insertion holes until the intermediate position of the side wall while contacting both the first groove member and second groove member, connection strength between the flat tubes and the first header tank can be improved.

Further, each flat tube has a width in a width direction perpendicular to a longitudinal direction of the flat tubes and to a longitudinal direction of the first heat tank, and the width of each flat tube is equal to that of the first groove member in the width direction. Therefore, the size of the first header tank is reduced relative to the flat tubes, and thereby reducing the size of the heat exchanger.

Preferably, the first groove member has a connection portion, extending from the side wall portion, for integrally forming the first groove member. Therefore, the connecting strength between the flat tubes and the first header is further improved, and it can prevent fluid from leaking from the first header tank to the outside.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PREFERRED EMBODIMENT

A preferred embodiment of the present invention will be described hereinafter with reference to the accompanying drawings.

Figure 1:
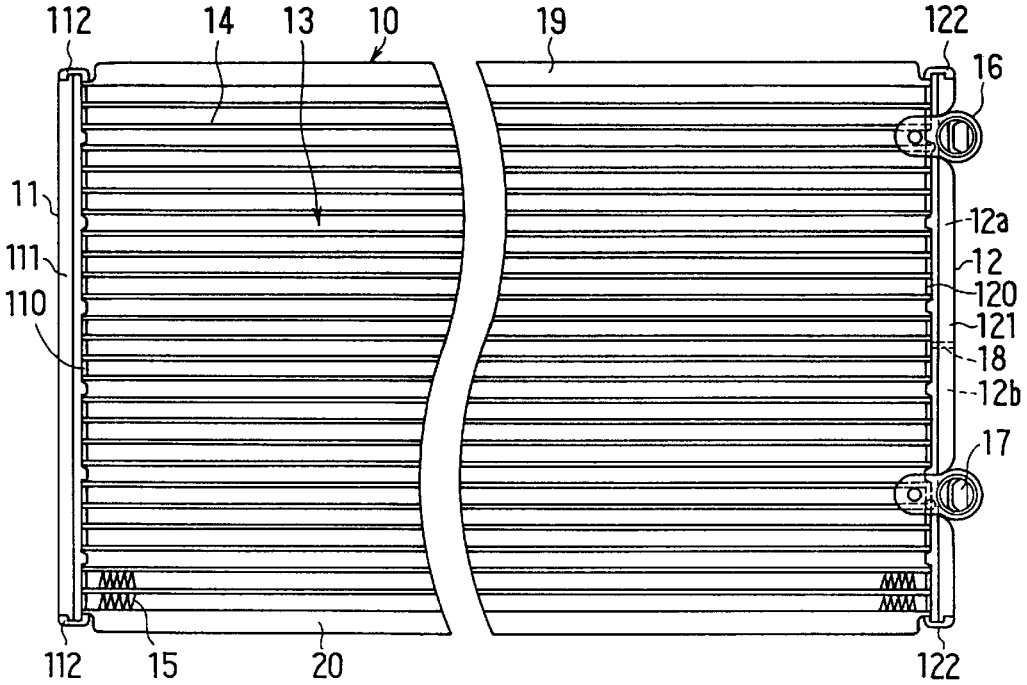
FIG. 1 is a front view of a condenser according to the preferred embodiment of the present invention.

In the embodiment, as shown in FIG. 1, a heat exchanger of the present invention is applied to a condenser 10 for an air conditioning apparatus for a vehicle. The condenser 10 cools and condenses high-pressure high-temperature gas-phase refrigerant discharged from a compressor (not shown) in a refrigerant cycle of the air conditioning apparatus. The condenser 10 is disposed in an engine compartment of the vehicle at a vehicle front side of a radiator for cooling an engine. The condenser 10 and the radiator are cooled by cool air (i.e., air outside the vehicle) blown by a cooling fan.

The condenser 10 includes a first header tank 11 and a second header tank 12 disposed to have a predetermined distance therebetween. Each of the first and second header tanks 11, 12 is formed in a substantial cylindrical shape to extend in a vertical direction (i.e., up-down direction, longitudinal direction of the header tanks) in FIG. 1. The condenser 10, which is generally called a multi-flow type condenser, has a core portion 13 for performing heat exchange. The core portion 13 is disposed between the first and second header tanks 11, 12. The core portion 13 includes a plurality of flat tubes 14 connected between the first and second header tanks 11, 12, and corrugated fins 15 attached between each adjacent flat tubes 14. The flat tubes 14 are parallel to each other, and laminated in the vertical direction in FIG. 1. Refrigerant flows through the flat tubes 14 horizontally in FIG. 1. One side ends of each flat tube 14 are communicated with the first header tank 11, and the other side ends of each flat tube 14 are communicated with the second header tank 12. Further, an inlet side pipe 16 and an outlet side pipe 17 are respectively attached to an upper part and a lower part of the second header tank 12. Refrigerant is introduced into the condenser 10 through the inlet side pipe 16 and is discharged from the condenser 10 through the outlet side pipe 17.

A separator 18 is disposed within the second header tank 12 between the inlet and outlet side pipes 16, 17, so that the inner space of the second header tank 12 is separated into upper and lower spaces 12*a*, 12*b*. Therefore, when refrigerant is introduced into the condenser 10 through the inlet side pipe 16, refrigerant flows into the upper space 12*a* of the second header tank 12 firstly, and then flows through an upper half of the flat tubes 14. Next, refrigerant from the upper half of the flat tubes 14 flows into a lower half of the flat tubes 14 through the first header tank 11, flows through the lower half of the flat tubes 14, and then flows into the outlet side pipe 17 via the lower space 12*b* of the second header tank 12.

The core portion 13 has side plates 19, 20 having a U-shaped cross-section, which are disposed at the top and bottom sides of the core portion 13 respectively. The side plates 19, 20 are connected to the corrugated fins 15 disposed at the top and bottom sides in the core portion 13, and to the first and second header tanks 11, 12, respectively. The side plates 19, 20 can be used for attaching the condenser 10 to a vehicle.

Figure 2:
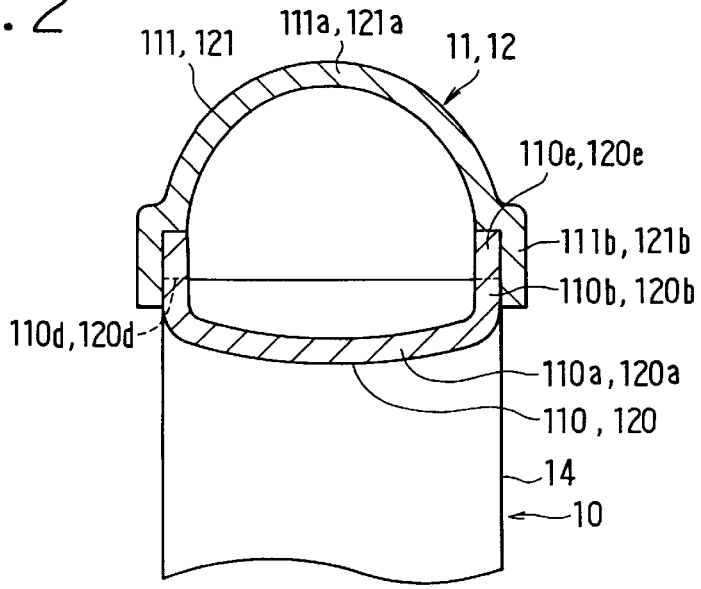
FIG. 2 is a cross-sectional view showing an assembling state of a header tank and a flat tube of the condenser according to the embodiment.

Next, an assembling structure between the flat tubes 14 and the first and second header tanks 11, 12 will be described. Note that the first and second header tanks 11, 12 have the same assembling structure in the embodiment. As shown in FIG. 2, the first and second header tanks 11, 12 are formed by connecting first groove members 110, 120 and second groove members 111, 121 respectively, to have substantial cylindrical hollow shapes. As shown in FIG. 1, cap members 112, 122 each of which is formed in a circular-plate like are attached to top and bottom ends of the first and second header tanks 11, 12 respectively.

Figure 3B:
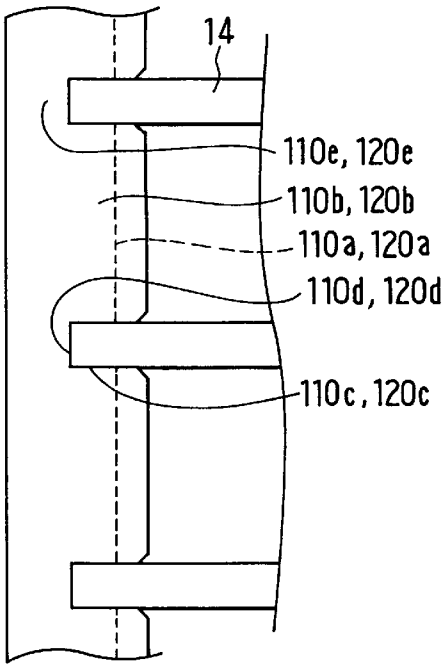
FIG. 3B is a side view corresponding to FIG. 3A.
Figure 3A:
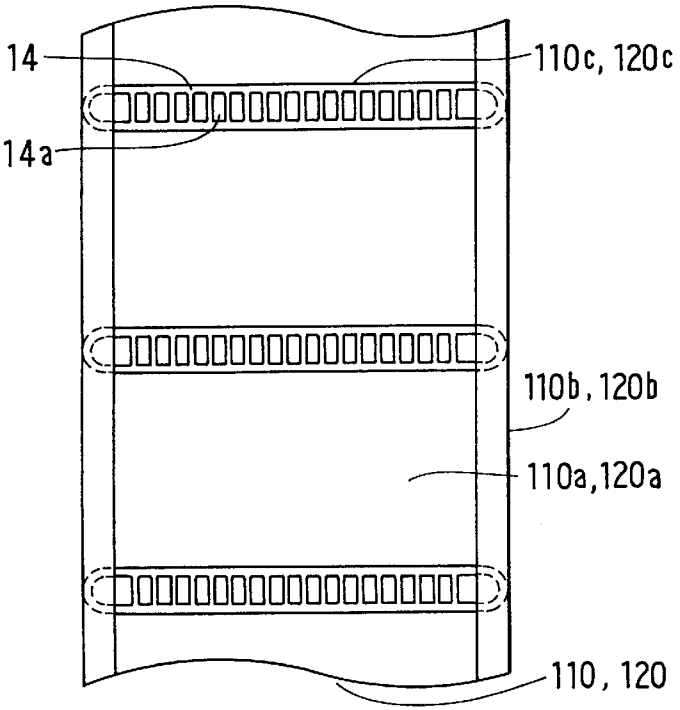
FIG. 3A is a partial top view showing an assembling state of a first groove member of the header tank and a plurality of flat tubes according to the embodiment.
Figure 3C:
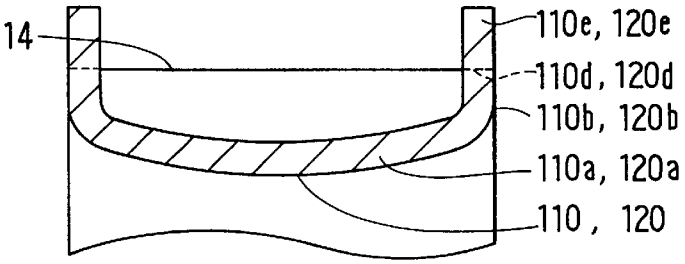
FIG. 3C is a cross-sectional view corresponding to FIG. 3A.
Figure 5A:
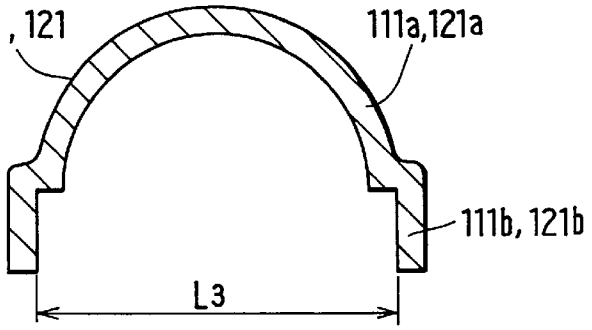
FIGS. 5A, 5B, 5C are exploded views of FIG. 2 according to the embodiment.
Figure 5B:
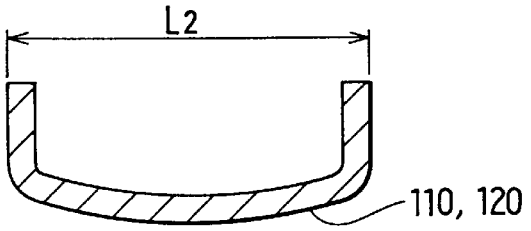
Figure 5C:
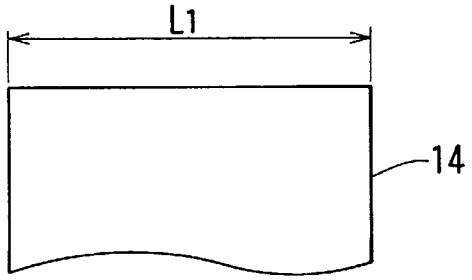
Figure 6:
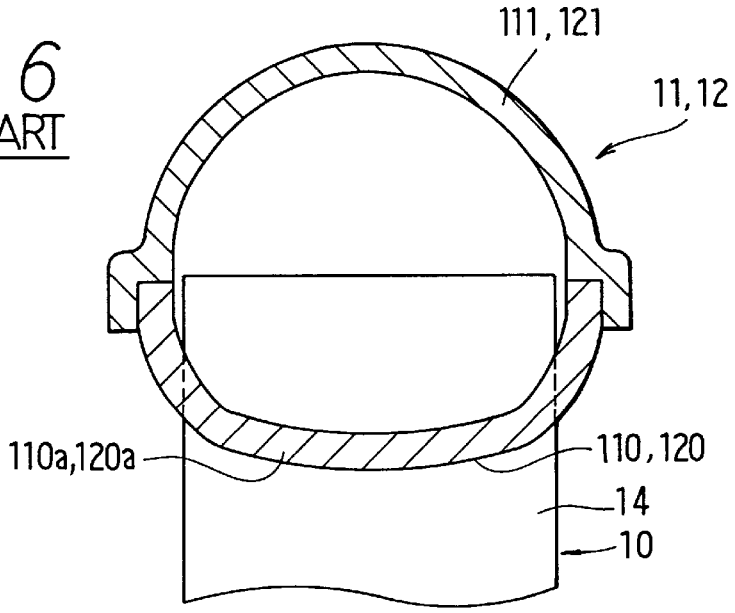
FIG. 6 PRIOR ART
FIG. 6 is a cross-sectional view showing an assembling state of a header tank and a flat tube in a conventional heat exchanger.

Each of the first groove members 110, 120 is formed by press-molding an aluminum material. Each flat tube 14 has a cross section in a direction perpendicular to a longitudinal direction of each flat tube 14, and has a longer width L1 in the cross-section. That is, the width L1 is a width of each flat tube 14 in a direction perpendicular to a longitudinal direction of the flat tubes 14 and to a longitudinal direction of the first and second header tanks 11, 12. As shown in FIGS. 5A, 5B, 5C, in the embodiment, the width L1 of the flat tube 14 is set to be equal to a width of the first groove members 110, 120 in the width direction. Each of the first groove members 110, 120 is formed approximately in U-shape in cross section, and has main wall portions 110*a*, 120*a* and side wall portions 110*b*, 120*b*, as shown in FIG. 2. Each of the main wall portions 110*a*, 120*a* is formed in an arc shape having a large curvature radius. The side wall portions 110*b*, 120*b* are bent outwardly from peripheral ends of the main wall portions 110*a*, 120*a* toward the longitudinal direction of the flat tubes 14. That is, by the main wall portions 110*a*, 120*a* and the side wall portions 110*b*, 120*b*, the U-shaped cross-sections of the first groove members 110, 120 are respectively formed. As shown in FIG. 3A, each of the flat tubes 14 has a plurality of refrigerant flow holes 14*a* provided in parallel, and the refrigerant flow holes 14*a* are formed in an aluminum-extrusion step.

Figure 4B:
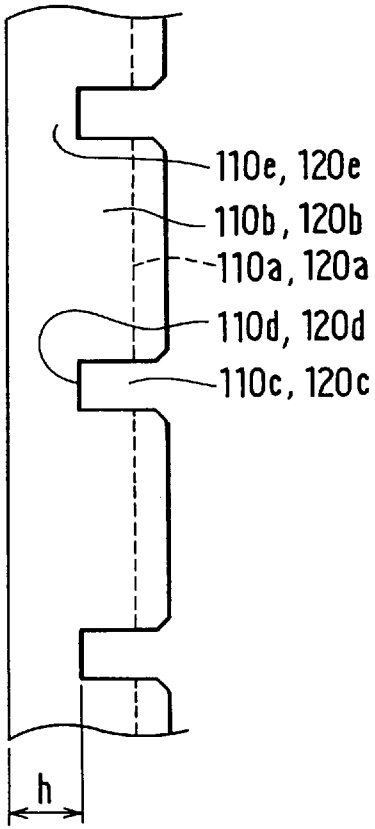
FIG. 4B is a side view corresponding to FIG. 4A.
Figure 4A:
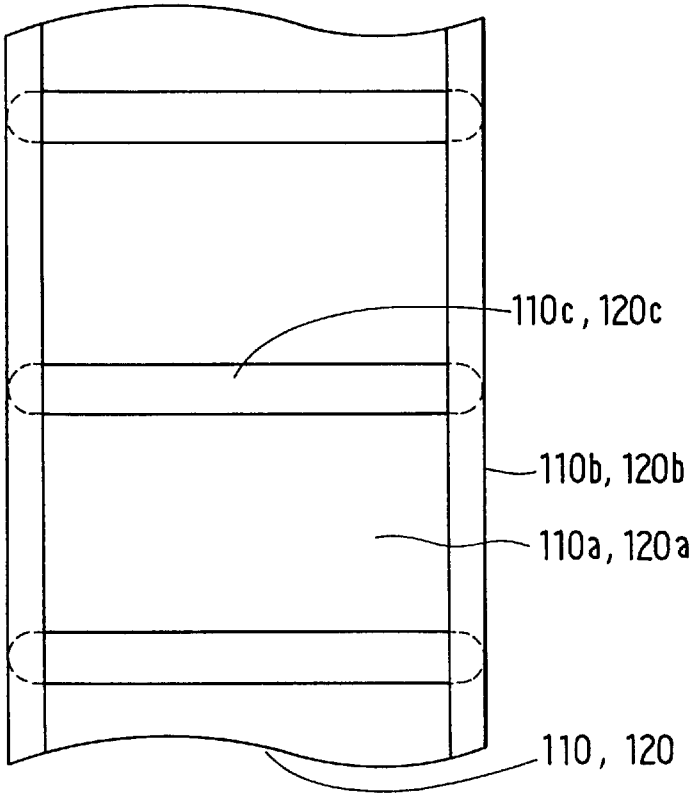
FIG. 4A is a partial top view showing the first groove member of the header tank according to the embodiment.
Figure 4C:
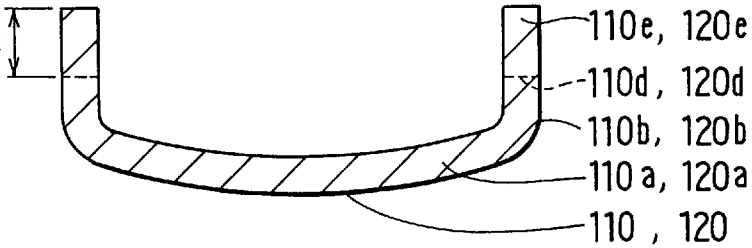
FIG. 4C is a cross-sectional view corresponding to FIG. 4A.

As shown in FIGS. 4A, 4B, 4C, the first groove members 110, 120 have a plurality of oval-shaped tube-insertion holes 110*c*, 120*c*. The tube-insertion holes 110*c*, 120*c* penetrate through the main wall portions 110*a*, 120*a* and reach midway positions of the side wall portions 110*b*, 120*b*. Therefore, insertion hole bottoms 110*d*, 120*d* of the tube-insertion holes 110*c*, 120*c* are placed at the midway positions (i.e., intermediate position) of the side wall portions 110*b*, 120*b*. The tube-insertion holes 110*c*, 120*c* are provided in the first groove members in parallel with the width direction.

Connection portions 110*e*, 120*e* extending from the side wall portions 110*b*, 120*b* are provided in the first groove members 110, 120 to integrally form the first groove members 110, 120 from each other. Each height h (i.e., extending length) of the connection portions 110*e*, 120*e* is preferably more than 1.5 times of the thickness t of the first groove members 110, 120 (i.e., $h \geqq 1.5t$). Therefore, the connection portions 110*e*, 120*e* have sufficient strength (stiffness), and are not deformed when the tube-insertion holes 110*c*, 120*c* are punched on the first groove members 110, 120. For example, in the embodiment, the thickness t is 1.2 mm and the height h is 2.4 mm.

The second groove members 111, 121 are also formed by press-molding an aluminum material, and have domed wall portions 111*a*, 121*a*. Each of the domed wall portions 111*a*, 121*a* is formed in an arc shape having a small curvature radius as compared with that of the main wall portions 110*a*, 120*a* of the first groove members 110, 120. Fitting portions 111*b*, 121*b*, are formed respectively in the second groove members 111, 121 at the ends of the domed wall portions 111*a*, 121*a*. The fitting portions 111*b*, 121*b* are fitted to the outside portions of the side wall members 110*b*, 120*b* of the first groove members 110, 120, when the second groove members 111, 121 are assembled with the first groove members 110, 120.

As shown in FIG. 5, a width L3 between inner surfaces of the fitting portions 111*b*, 121*b* is also set to be equal to the widths L1 and L2. For example, each of the widths L1, L2 and L3 is 16 mm. However, because the flat tubes 14 and the first groove members 110, 120 are inserted into the fitting portions 111*b*, 121*b* of the second groove members 111, 121, each of the widths L1 and L2 is set to have a minus dimension tolerance and the width L3 is set to have a plus dimension tolerance, preferably. For example, when each of the widths L1, L2 and L3 is 16 mm, the width L1, L2 have a dimension tolerance of −0.2 mm and the width L3 has a dimension tolerance of +0.2 mm. Although the widths L1 and L2 are set to have the same length, they might be different in length to the degree as much as the dimension tolerance. Each thickness of the second groove members 111, 121 is substantially equal to that of the first groove members 110, 120. For example, each thickness of the second groove members 111, 121 is 1.2 mm.

When the condenser 10 is assembled, the flat tubes 14 are attached to the first and second header tanks 11, 12 by fully inserting both ends of the flat tubes 14 into the tube-insertion holes 110*c*, 120*c* until the both ends of the flat tubes 14 contact the insertion hole bottoms 110*d*, 120*d*. Therefore, the flat tubes 14 are accurately readily inserted into the tube-insertion holes 110*c*, 120*c* so that the flat tubes 14 are readily accurately assembled to the first and second header tanks 11 and 12.

Further, each part of the condenser 10 are made of aluminum and is integrally brazed together. The first groove members 110, 120 and the second groove members 111, 121 are made of the same material, for example, clad aluminum made by cladding aluminum A4050 as skin material (i.e., brazing material) on both sides of aluminum A3103 as core material. The flat tubes 14 made of aluminum A1197 are formed by aluminum extrusion step, and are not clad with brazing material. Therefore, when the condenser 10 is integrally brazed in a furnace, the both ends of the flat tubes 14 are brazed to the first and second groove members 110, 120 and 111, 121 using brazing material supplied from the first and second groove members 110, 120 and 111, 121.

When the flat tubes 14 are inserted into the tube-insertion holes 110*c*, 120*c*, each two ends of the flat tubes 14 contact the insertion hole bottoms 110*d*, 120 of the tube-insertion holes 110*c*, 120*c*, and each two end parts thereof are held by the tube-insertion holes 110*c*, 120*c* and the inner surfaces of the fitting portions 111*b*, 121*b*. Therefore, the flat tubes 14 are brazed to the first and second header tanks 11, 12 in a sufficient brazing strength.

Further, in the embodiment, because each width L1 of the first groove members 110, 120 is set to be equal to the width L2 of the flat tubes 14, downsized first and second header tanks 11, 12 can be provided. The corrugated fins 15 are brazed to the flat tubes 14, and are made of clad aluminum. That is, the corrugated fins 15 are made by cladding aluminum A4343 on the both sides of aluminum A3923 as core material, for example.

Although the present invention has been fully described in connection with the preferred embodiment thereof with reference to the accompanying drawings, it is to be noted that various changes and modifications will become apparent to those skilled in the art.

For example, in the above-described embodiment, the flat tubes 14 are molded by extrusion and are not clad with brazing material; however, the flat tubes 14 may be clad with brazing material by spraying or the like. In this case, because brazing material is supplied from not only the first and second header tanks 11, 12 but also the flat tubes 14, the brazing strength between the flat tubes 14 and the first and second header tanks 11, 12 is improved.

In the above-described embodiment, each of the main wall portions 110*a*, 120*a* of the first groove members 110, 120 are formed in the arc shape having a large curvature radius; however, the main wall portions 110*a*, 120*a* may be formed in a flat shape extending in a direction perpendicular to the longitudinal direction of the flat tubes 14.

In the above-described embodiment, the present invention is applied to a condenser for an air conditioning apparatus for a vehicle; however, the present invention can be also applied to other heat exchangers for various use.

Such changes and modifications are to be understood as being within the scope of the present invention as defined by the appended claims.

What is claimed is:

1. A heat exchanger comprising:

a plurality of flat tubes disposed in parallel with each other, each of said flat tubes has a first end and a second end in a longitudinal direction of said flat tubes;

a first header tank connected to each first end of said flat tubes; and a second header tank connected to each second end of said flat tubes, wherein:

said first header tank includes a first groove member having a plurality of insertion holes into which said flat tubes are inserted in the longitudinal direction of said flat tubes, and a second groove member connected to an outer peripheral portion of said first groove member;

said first groove member is formed in a U-shaped cross section having a bottom wall portion and a side wall portion extending from said bottom wall portion;

each of said insertion holes is formed to penetrate through said bottom wall portion and to extend from said bottom wall portion until an intermediate position of said wall portion; and each first end of said flat tubes is inserted into said insertion holes until said intermediate position of said side wall while contacting both said first groove member and second groove member.

2. The heat exchanger according to claim 1, wherein each flat tube has a width in a width direction perpendicular to the longitudinal direction of said flat tubes and to a longitudinal direction of said first header tank, and the width of each flat tube is equal to a width of said first groove member in the width direction.

3. The heat exchanger according to claim 2, wherein said first groove member has a connection portion, extending from said side wall portion, for integrally forming said first groove member.

4. The heat exchanger according to claim 1, wherein said connection portion of said first groove member extends from said side wall portion by a height in an extending direction of said wall portion, and the height is set to be more than 1.5 times of a thickness of said first groove member.

5. The heat exchanger according to claim 1, wherein:

said second groove member has an attachment portion, disposed at an outer side of said side wall portion of said first groove member, for attaching said first groove member to said second groove member; and each first end of said flat tubes is disposed inside said attachment portion to contact said attachment portion.

6. The heat exchanger according to claim 1, wherein:

said first and second groove members are made of an aluminum clad material clad by a brazing material on an aluminum material;

each flat tube is made of aluminum, and has therein a plurality of openings arranged in parallel; and each first end of said flat tubes are brazed to said first and second groove members using the brazing material of said first and second groove members.

7. A heat exchanger comprising:

a plurality of flat tubes disposed in parallel with each other, each of said flat tubes has a first end and a second end in a longitudinal direction of said flat tubes;

a first header tank connected to each first end of said flat tubes; and a second header tank connected to each second end of said flat tubes, wherein:

each of said first header tank and said second header tank includes a first groove member having a plurality of insertion holes into which said flat tubes are inserted in the longitudinal direction of said flat tubes, and a second groove member connected to an outer peripheral portion of said first groove member;

said first groove member is formed in a U-shaped cross section having a bottom wall portion and a side wall portion extending from said bottom wall portion;

each of said insertion holes is formed to penetrate through said bottom wall portion and to extend from said bottom wall portion until an intermediate position of said wall portion;

said first ends and said second ends of said flat tubes are inserted into said insertion holes until said intermediate position of said side wall while contacting both said first groove member and second groove member; and each flat tube has a width in a width direction perpendicular to the longitudinal direction of said flat tubes and to a longitudinal direction of said first header tank and said second header tank, and the width of each flat tube is equal to a width of said first groove member in the width direction.

* * * * *